US006655682B2

(12) United States Patent
Becker et al.

(10) Patent No.: US 6,655,682 B2
(45) Date of Patent: Dec. 2, 2003

(54) DEVICE FOR FIXING THE POSITION OF A SHEET ON A FEEDING TABLE

(75) Inventors: Willi Becker, Bammental (DE); Wolfgang Dolz, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 31 days.

(21) Appl. No.: 09/894,683

(22) Filed: Jun. 28, 2001

(65) Prior Publication Data

US 2002/0011162 A1 Jan. 31, 2002

(30) Foreign Application Priority Data

Jun. 28, 2000 (DE) ..... 100 31 508

(51) Int. Cl.[7] ..... B65H 9/04
(52) U.S. Cl. ..... 271/245; 271/247
(58) Field of Search ..... 271/245, 246, 271/247

(56) References Cited

FOREIGN PATENT DOCUMENTS

| | | |
|---|---|---|
| DE | 4134767 A1 | 4/1993 |
| DE | 4306238 A1 | 9/1994 |
| DE | 4004447 C2 | 5/1998 |

*Primary Examiner*—David H. Bollinger
(74) *Attorney, Agent, or Firm*—Laurence A. Greenberg; Werner H. Stemer; Gregory L. Mayback

(57) ABSTRACT

A device for fixing the position of a sheet includes a feeding table for transporting the sheet; at least one front lay disposed in vicinity of the feeding table and, in a working position, protruding upwardly beyond the plane of the feeding table; a swivellable holder to which the front lay and an adjusting device for the front lay are secured; and a adjusting device secured to the holder, the front lay and the adjusting device being disposed separated from one another on the holder, the front lay being in continuous biasing engagement, under tension, with the adjusting device, so that, by changing the position of the holder, the front lay and the adjusting device are movable from the working position into a neutral position and, conversely, from the neutral position into the working position.

15 Claims, 9 Drawing Sheets

DEVICE FOR FIXING THE POSITION OF A SHEET ON A FEEDING TABLE

BACKGROUND OF THE INVENTION

Field of the Invention

The invention relates to a device for fixing the position of a sheet on a feeding table of a sheet-fed printing press.

A printing press comprises a feeding table whereon a sheet is transported to a printing unit. During the transportation of the sheet, an edge of the sheet comes into contact with front lays which limit the movement of the sheet and define a line for aligning the sheet. After the alignment of the sheet, the front lay is moved away from the table, so that the edge of the sheet, which is disposed on the alignment or adjustment line, can be picked up by a gripper, and the sheet can consequently be transported to the printing unit.

From the published German Patent Document DE 40 04 447 C2, a feed lay or lay mark for aligning sheets which are guided on a feeding table have become known heretofore. The feeding table has an adjustable stop which is permanently connected to the feeding table. The feed lay is biased in the direction of the stop by a spring element. The front lay is articulatedly connected to a base body and can be pivoted together with the spring element from a working position into a neutral position. The working position is the position wherein the front lay defines the line for aligning the sheet. In the neutral position, the front lay is disposed beneath the feeding table, so that the front edge of the sheet can be picked up by a gripper.

A disadvantage of the arrangement described in the aforementioned German patent document is that the time at which the front lay leaves the stop is dependent upon the setting of the stop and is thus not precisely specified. This time uncertainty must be accounted for, and shortens the time available for aligning and stabilizing the sheet. The time at which the front lay leaves the working position must therefore be moved ahead or advanced accordingly. Wear is also to be expected due to the contact of the front lay with the adjustable stationary stop, which can result in the front lay being disadjusted or moved out of alignment.

The published German Patent Document DE 43 06 238 A1 discloses a device for fixing the position of a sheet, and a feed table for transporting the sheet, including a front lay that is disposed in the region of the feed table and that, in a working position, protrudes upwardly from the plane of the feed table, the front lay being fixed at a pivotable holding device and serving simultaneously as the adjusting device. Devices of this type are difficult to handle.

SUMMARY OF THE INVENTION

It is accordingly an object of the invention to make available an improved device for fixing the position of a sheet on a feeding table by aligning at front lays a sheet that is transported on a feeding table.

With the foregoing and other objects in view, there is provided, in accordance with the invention, a device for fixing the position of a sheet, comprising a feeding table for transporting the sheet; at least one front lay disposed in vicinity of the feeding table and, in a working position, protruding upwardly beyond the plane of the feeding table; a swivellable holder to which the front lay and an adjusting mechanism for the front lay are secured; and an adjusting device secured to the holder, the front lay and the adjusting device being disposed separated from one another on the holder, the front lay being in continuous biasing engagement, under tension, with the adjusting device, so that, by changing the position of the holder, the front lay and the adjusting device are movable from the working position into a neutral position and, conversely, from the neutral position into the working position.

In accordance with another feature of the invention, the adjusting device is rotatably mounted, and is rotatable for adjusting the position of the front lay.

In accordance with a further feature of the invention, the adjusting device is formed with lock recesses and includes a lock element, the lock recesses cooperating with the lock element for enabling rotation of the adjusting device at prescribed angles.

In accordance with an added feature of the invention, the lock element is constructed as a leaf spring, which is prestressed with the aid of a lock nose in a direction towards the adjusting device and, when the adjusting device is rotated, the lock element catches in the lock recesses, so that the adjusting device is rotatable further only with increased torque.

In accordance with an additional feature of the invention, the position-fixing device includes a servomotor connected to the adjusting device for adjusting the rotational position of the adjusting device.

In accordance with yet another feature of the invention, the adjusting device is formed with a contact surface to which a tool for adjusting the position of the adjusting device is applicable.

In accordance with yet a further feature of the invention, the adjusting device is disposed beneath the feeding table; and the feeding table is formed with an opening in vicinity of the adjusting device, via which the contact surface is accessible with the aid of a tool.

In accordance with yet an added feature of the invention, the adjusting device includes a rotary element mounted so as to be rotatable about an axis of rotation; the front lay having a contact part in contact with a side margin of the rotary element; at least one of the rotary element and the position of the axis of rotation being constructed so that, when the rotary element is rotated about the axis of rotation, a spacing between the contact part and the axis of rotation is modified.

In accordance with yet an additional feature of the invention, the contact part and the rotary element are operatively connected to one another via at least one of an anti-friction bearing and a slide ring.

In accordance with still another feature of the invention, the adjusting mechanism serves for adjusting the spacing between the front lay and the adjusting device.

In accordance with still a further feature of the invention, the position-fixing device includes at least one tensioning device for prestressing the front lay in a direction towards the stop element.

In accordance with still an added feature of the invention, the front lay is formed at least partly of an elastic material; and is secured to the holding device in a manner that the front lay is prestressed in a direction towards the adjusting device.

In accordance with still an additional feature of the invention, the rotary element is formed as an Archimedes' spiral.

In accordance with another feature of the invention, the rotary element is formed as a disk which is rotatable about an eccentrically disposed axis of rotation.

In accordance with a concomitant feature of the invention, the adjusting device is connected to a disk formed with lock recesses in a side margin thereof; the disk having a first and a second stop surface; and a stop bolt is disposed between the first and the second stop surfaces, the stop bolt, by coming into contact with the first and the second surfaces, serving to limit the range of rotation of the adjusting device.

The invention offers the advantage that the front lay is preferably prestressed against an adjusting device without play and connected to the adjusting device in one structural unit, the front lay being movable together with the adjusting device from a working position into a neutral position. In this way, the front lay is always in contact with the adjusting device, so that, subsequent to the transition from the neutral position into the working position, the front lay is aligned at the predetermined adjustment line.

Because at least two, and in most instances more than two, front lays are advantageously distributed over the width of the feeding table, it is expedient for the front lays to be individually adjustable. For straight sheet edges, all front lays can be used as stops for the sheet. The sheet edge is thus given optimal support in the stopping process.

For convex sheet edges, the middle front lays are preferably removed. Consequently, only two front lays at the outer region are used to prevent the sheet from rocking. For thin sheets with edges that are not straight, it may be necessary to adapt several front lays to the curvature of the sheet in order to prevent displacement or stressing of the sheet. This ensures an optimal adjustment of various printing materials.

A simple embodiment of the adjustable adjusting device calls for it to be rotatably mounted and provided with lock recesses. The rotatable mounting of the adjusting device ensures a simple adjustment of the position of the front lay. The use of lock recesses in conjunction with a lock element is advantageous in that the adjusting device is enabled to be rotated at prescribed angles in a precise manner. It is possible, thereby, to achieve very precise settings of the front lay.

In a preferred embodiment, the lock element is formed as a leaf spring having a lock nose which is allocated or assigned to the lock recesses. This embodiment ensures a cost-effective realization of the lock element.

The adjusting device is advantageously connected to a servomotor with which the position of the adjusting device can be set. The use of a servomotor permits a very precise adjustment of the adjusting device, which is additionally independent of the local position of the adjusting device. The adjusting device is thereby easy to adjust even when access thereto is difficult.

The adjusting device is also easy to adjust because it has a surface upon which a tool for adjusting the position of the adjusting device is able to be placed. Thus, the position of the adjusting device can be adjusted without using complex technical equipment.

The adjusting device is advantageously disposed beneath the feeding table, thereby providing a compact construction. In addition, an opening is formed in the feeding table in the vicinity of the adjusting device, via which the contact surface of the adjusting device can be accessed with a tool. In this way, the adjusting device can be adjusted easily from above.

The adjusting device is advantageously constructed in the form of a rotating element adjoined by the front lay via a contact part at a side margin of the rotating element. The rotating element and/or the axis of rotation of the rotating element are constructed so that, when the rotating element is rotated about the axis of rotation, the distance between the contact part and the axis of rotation is changed. This embodiment represents a simple construction of the adjusting device.

To prevent friction and to increase the accuracy of the position of the front lay, the contact part is braced against the adjusting device via a slide ring or anti-friction bearing.

In a further development of the invention, the front lay includes an adjusting mechanism with which the distance between the contact part and the front lay can be set. An initial setting of the front lay can be performed by using the adjusting mechanism. With this initial setting, a number of front lays can be aligned on a prescribed adjusting line.

In a preferred embodiment, the front lay is biased in a direction towards the stop element and the adjusting mechanism, respectively, by a tensioning mechanism. By using a prestressed front lay, freedom of play is afforded to the front lay in any situation.

A particularly advantageous embodiment of the invention provides for the front lay be produced at least partly from an elastic material. Additional stressing mechanisms for biasing the front lay in the direction towards the stop element are thus dispensed with or spared. A compact and economical construction is thereby possible.

A preferred embodiment of the rotating element is formed as an Archimedes' spiral or a disk which is rotatable about an eccentrically arranged axis. In both embodiments, the distance between the side margin of the rotating element and the axis of rotation can be varied in dependence upon the rotational position of the rotating element.

Another advantageous embodiment of the invention is realized by an adjusting device comprising a disk at the outer margin of which lock recesses are provided, the disk being formed with first and second stop surfaces which are bringable into contact with a stop bolt. By using the stop bolt and the stop surfaces, a defined angular range is prescribed for the rotation of the adjusting device. A setting in which all the front lays stand on a common straight line is thereby easy to find.

Other features which are considered as characteristic for the invention are set forth in the appended claims.

Although the invention is illustrated and described herein as embodied in a device for fixing the position of a sheet on a feeding table, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

The invention is described hereinbelow by way of example in a sheet-fed printing press, the device according to the invention being introducible into any type of printing press wherein a part must be aligned at a predetermined adjustment line and then picked up from the side of the adjustment line and moved forward.

Figure 1:
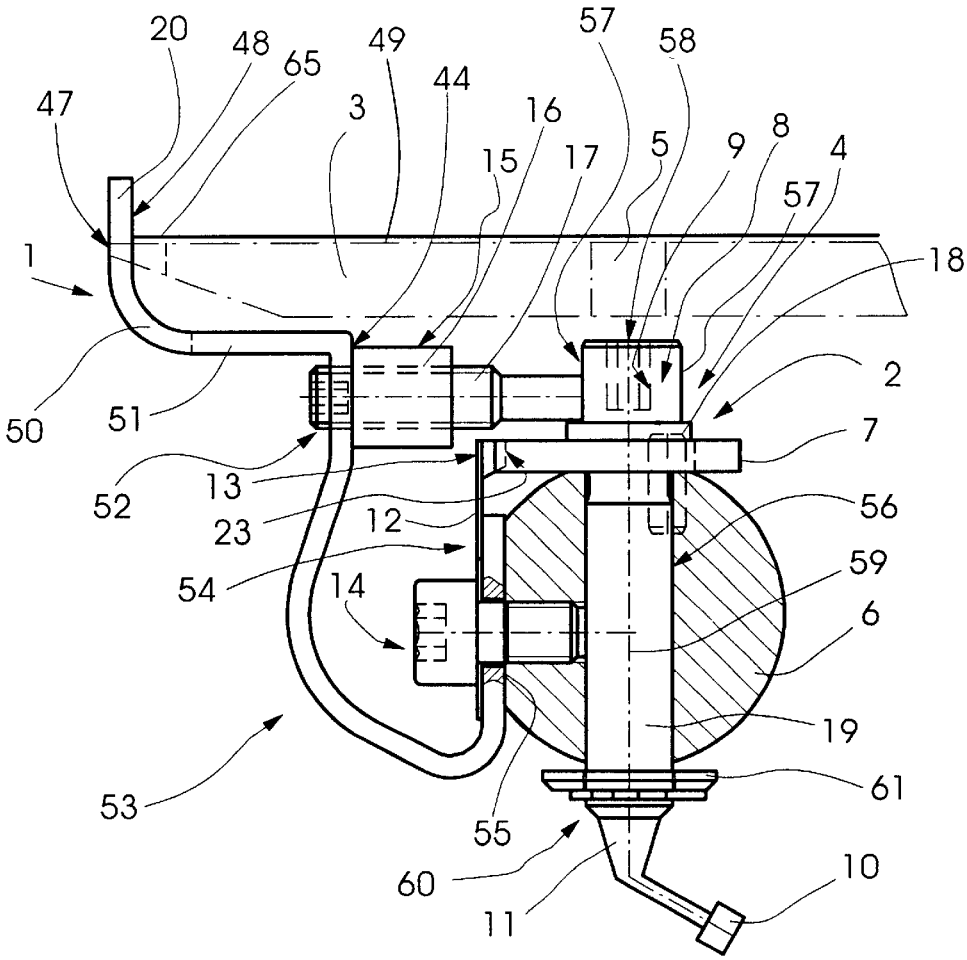
FIG. 1 is a diagrammatic side elevational view, partly in cross section, of a front lay with a holding device.

Referring now to the drawings and, first, particularly to FIG. 1 thereof, there is shown therein a feeding table 3 with a front lay 1 in working position. In the working position, a contact plate 20 of the front lay 1 is disposed at a front edge 47 of the feeding table 3 so that the contact plate 20 protrudes upwardly beyond a supporting surface 49 of the feeding table 3 and is disposed parallel to the front edge 47 on a predetermined alignment or adjustment line 46 (note FIG. 2).

The contact plate 20 has an intercepting surface 48, which, in the working position, is oriented approximately perpendicularly to the supporting surface 49 of the feeding table 3.

The contact plate 20 extends beneath the feeding table 3 into a first region 51 following a bend 50. As shown in FIG. 1, in the working position of the contact plate 20, also shown in phantom at 25 in FIG. 4, the first region 51 is realized approximately parallel to the supporting surface 49 and extends in a direction towards an adjusting device 4. The first region 51 merges into a second region 52, which is disposed approximately perpendicularly to the first region 51. The second region 52 merges via a third region 53 into a fourth region 54. The third region 53 has an asymmetrical U shape, and the fourth region 54 extends approximately parallel to the second region 52. The fourth region 54 is in contact with a contact surface 55 of a shaft 6. The fourth region 54 is fixedly screwed to the shaft 6 by a first screw 14. The contact surface 55 is advantageously oriented perpendicularly to the feeding table 3.

The shaft 6 is formed with a centrally oriented borehole 56 which is oriented parallel to the contact surface 55. Thus, in the working position, the borehole 56 is oriented perpendicularly to the feeding table 3. In the borehole 56, a rod 19 having a lock disk 7 at the top end thereof, as viewed in FIG. 1, for example, is rotatably mounted. The lock disk 7 lies on the shaft 6. Above the lock disk 7, a stop element 8 in the form of an eccentric disk is provided. A side margin 57 of the stop element 8 is disposed parallel to the longitudinal axis of the rod 19. The stop element 8 has a substantially cylindrical construction, with an axis of rotation situated outside the midpoint of the cross-section of the cylinder formed by the stop element 8. The axis of rotation of the stop element 8 is coaxial with the axis of rotation 59 of the rod 19.

The stop element 8 has an upper side, as viewed in FIG. 1, for example, which is oriented parallel to the underside of the feeding table 3, and is formed with an opening 58, which is bounded by an interior wall 9 of the stop element 8. The interior wall 9 is advantageously constructed as a contact surface in the shape of an interior hexagon. The feeding table 3 is formed with a second recess 5 above the opening 58. The second recess 5 is constructed so that a tool can be guided into the opening 58 through the feed table 3 from above, in order to vary the rotational position of the stop element 8. A hex or hexagon key is preferably used as the tool. In its simplest form, the second recess 5 is a cylindrical recess.

The lock disk 7 is disposed centrosymmetrically to the axis of rotation 59 of the rod 19. Lock recesses 13 are provided at the outer perimeter of the lock disk 7. A lock element 12 is provided in the shape of a leaf spring, which is screwed to the shaft 6 by the first screw 14, the lock element 12 having a lock nose 23 in the shape of an outward bend at the top end thereof, as viewed in FIG. 1. The lock nose 23 is disposed in a region of the outer perimeter of the lock disk 7 and engages in a respective lock recess 13. Interaction of the lock recesses 13 and the lock element 12 ensures a precise rotation of the stop element 8 into predetermined angular positions.

The second region 52 of the front lay 1 is braced, via a contact part 15, against a side edge of the stop element 8, which represents the outer perimeter 57 thereof. The contact part 15 is advantageously constructed in the shape of a nut 16 through which a threaded adjusting screw 17 is guided. The nut 16 is secured at the second region 52 of the front lay 1 via a second weld or joint 44. The front end of the adjusting screw 17 is in contact with the side edge 57 of the stop element 8. The front lay 1 is shaped by the third region 53 thereof so that the second region 52 of the front lay 1 has a tensioning bias acting in a direction towards the stop element 8. In the second region 52, a borehole is formed, through which the other end of the adjusting screw 17 extends. The contact part 15 is thus clamped between the second region 52 and the outer perimeter 57. The contact part 15 serves for setting or establishing a defined spacing between the outer perimeter 57 and the second region 52 and thus a defined position of the intercepting surface 48. By turning the adjusting screw 17, the position of the intercepting surface 48 relative to the feeding table 3 can be adjusted. The adjusting screw 17 and the nut 16 represent an adjusting mechanism. By the adjusting mechanism 16, 17, a basic setting of the front lay 1 can be executed. With the basic setting, several front lays can be aligned on a predetermined adjustment line.

In addition, due to the eccentric shape of the stop element 8, the position of the intercepting surface 48 can be set by turning the stop element 8. The shaft 6 with the rod 19 and the stop element 8 represent an adjusting device 4 by which the position of the intercepting surface 48 can be adjusted from the basic setting that was previously set using the contact part 15 and the adjusting screw 17.

The rod 19 has a connecting element 60 at the bottom end thereof, as viewed in FIG. 1, to which an elastic shaft 11 is attached. The elastic shaft 11 is connected to a controllable servomotor 10. The rod 19 and thus the stop element 8 are turned, via the elastic shaft 11, by actuating the servomotor 10 accordingly. In this manner, the intercepting surface 48 can be displaced, regardless of the accessibility of the front lay 1, by actuating the servomotor 10 accordingly. Because a servomotor 10 is used, the front lay 1 can be adjusted by remote control. The remote control can be accomplished via programs of a control computer of the sheet-fed printing machine. Of course, this is also possible during the printing-machine cycle.

In a relatively simple embodiment, the front lay 1 comprising the contact plate 20, and the first, second, third, and fourth regions 51, 52, 53 and 54, is constructed in the shape of a suitably bent thin plate. Advantageously, the front lay 1 is produced from spring steel. Because the front lay 1 is biased in the direction towards the stop element 8 in the second region 52, due to the shape and the connection thereof to the shaft 6, additional devices for biasing the contact plate 20 can be dispensed with. This ensures a cost-effective and compact construction.

The lower end of the rod 19 has an axial guard 61 which limits the axial mobility of the rod 19 in the shaft 6. The shaft 6, the screw 14 and the rod 19, together, represent a holding device 2 for the front lay 1 and the adjusting device 4.

Figure 2:
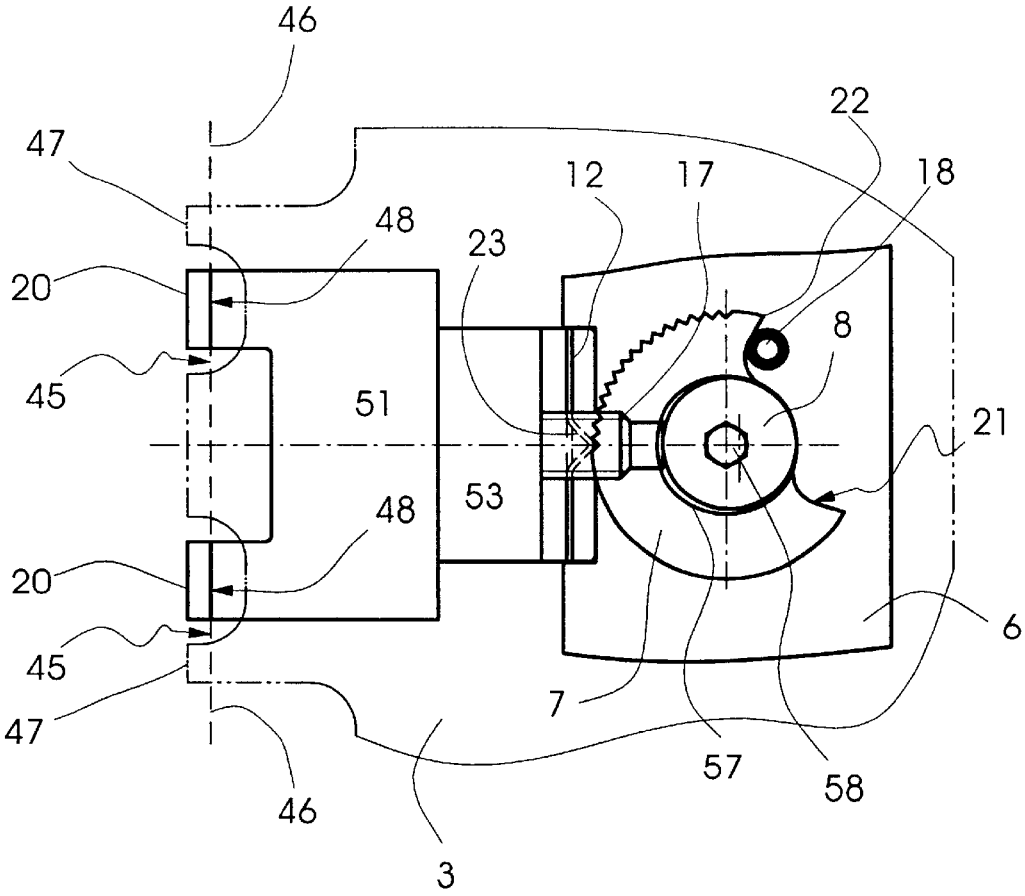
FIG. 2 is a top plan view of FIG. 1 showing the front lay with a feeding table.

FIG. 2 shows the arrangement of FIG. 1, as viewed from above and from the perspective of the feeding table 3, which is represented only diagrammatically, in phantom. The feeding table 3 is formed with notches 45 in the region of a front lay 47, through which respective contact plates 20 are guided from below. The intercepting surfaces 48 of the contact plates 20 are aligned at the adjusting line 46. The notches 45 permit the arrangement of the adjustment line 46 in the region of the support surface 49. Thus, a sheet that is situated on the feeding table 3, with the leading edge of the sheet abutting the intercepting surface 48, is located in the region of the support surface 49, so that the whole surface of the sheet is held by the feeding table 3.

The first region 51 and the third region 53 of the front lay 1 are clearly visible in FIG. 2. The adjusting screw 17 contacts the outer perimeter 57 of the stop element 8. The shape of the lock nose 23 of the lock element 12 is also clearly visible. In this exemplifying embodiment, the lock nose 23 is locked in the first lock recess 13. The lock disk 7 is formed with a recess which is bounded by first and second stop surfaces 21 and 22. Installed in the shaft 6 is a stop bolt 18, which is disposed in the region of the recess of the lock disk 7, so that rotation of the stop element 8 is limited by the fact that the first or second stop surface 21, 22 strikes the stop bolt 18. The lock disk 7 can be rotated only within a predetermined angular range due to the stop bolt 18 and the first and second stop surfaces 21 and 22. A maximum permissible angular range for rotating the adjusting device 4 is thereby prescribed. FIG. 2 clearly shows the shape of the lock disk 7, which has a central opening through which the stop element 8 extends. The lock disk 7 is firmly connected to the stop element 8.

Figure 3:
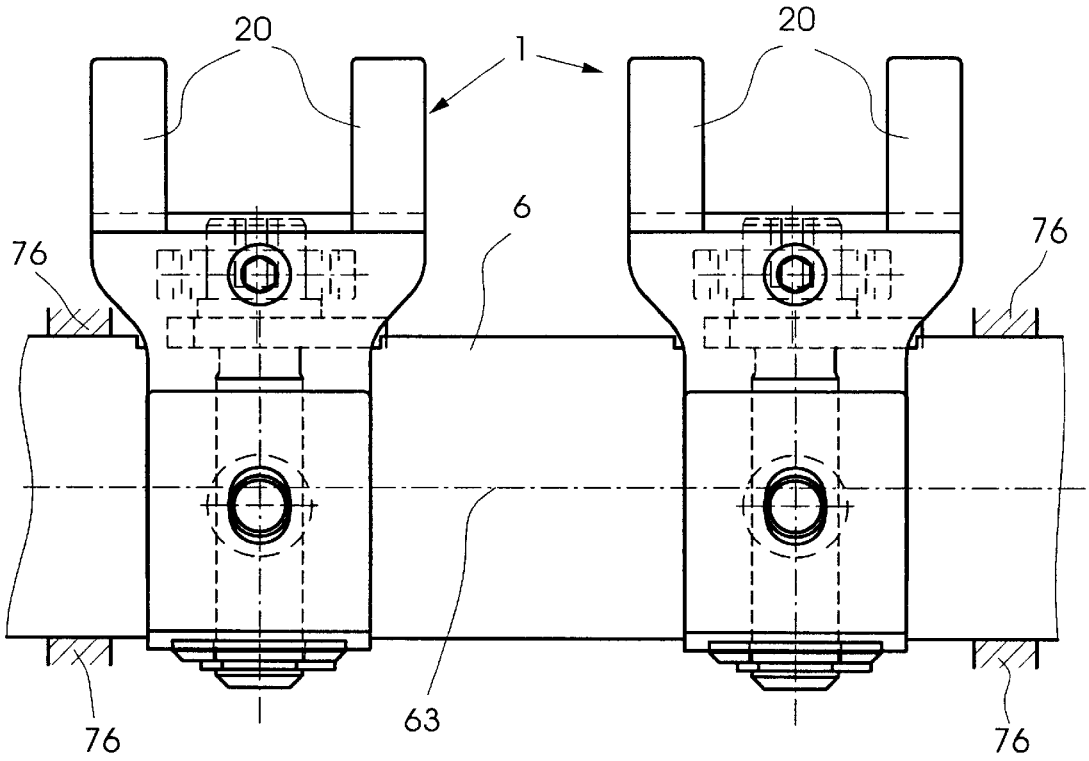
FIG. 3 is a front elevational view of FIG. 1 showing a shaft with two front lays.

FIG. 3 shows a device with two front lays 1, which are affixed onto a common shaft 6. The front lays 1 are aligned so that the stop plates 20 of the two front lays 1 are arranged on a common adjustment line 46. In the same way, additional front lays 1 on the shaft 6 can also be distributed along the front or leading edge 47 of the feeding table 3. A drive is also provided for rotating the shaft 6, by the aid of which the shaft 6 shown in FIG. 4, for example, is rotatable. The shaft 6 is mounted in a bearing support 76 and connected to the sheet-fed printing machine.

Figure 4:
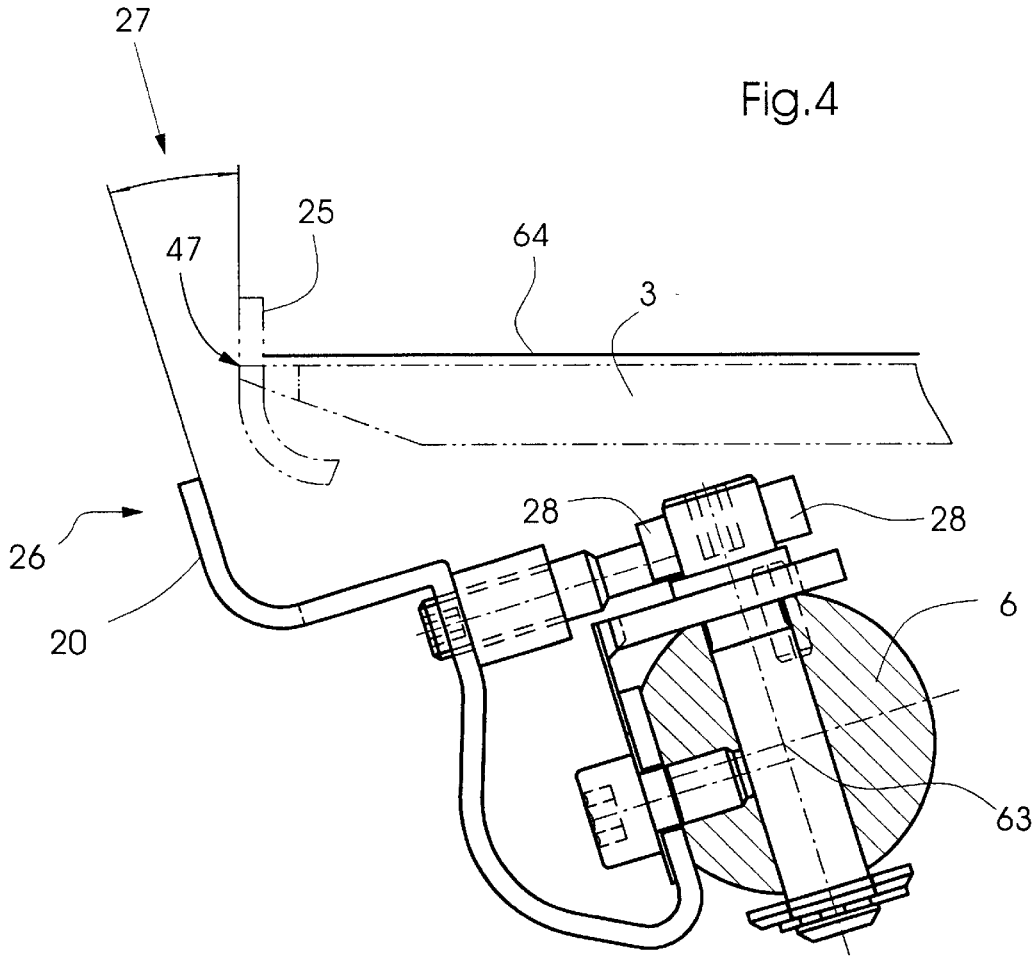
FIG. 4 is a view similar to that of FIG. 1 of a front lay in a neutral or inactive position, shown with a slide bearing.

FIG. 4 shows a device similar to that of FIG. 1, but with a slide ring 28 disposed between the adjusting screw 17 and the stop element 8 for reducing sliding friction. The slide ring 28 prevents wear of the stop element or the adjusting screw 17 and additionally accomplishes a precise adjustment of the position of the intercepting surface 48 due to low-frictional movement of the stop element 8 relative to the adjusting screw 17. The slide ring 28 is rotatably mounted on the stop element 8 and secured against axial movement. The adjusting screw 17 is braced against the outer circumference of the slide ring 28, and is resiliently prestressed against the slide ring 28.

FIG. 4 shows the front lay 1 in the neutral or inactive position thereof at 26, wherein the contact plate 20 is tilted about a central axis 63 over a pivot angle 27 relative to the working position 25 of the contact plate 20, which is represented in phantom. The pivot angle 27 is so dimensioned that, in the neutral or inactive position 26 of the contact plates 20, the latter are tilted far enough away from the front or leading edge 47 in the forward and downward directions so that the feeding table 3 and, thus, the sheet 64 lying thereon can be accessed freely in the region of the front or leading edge 47. This is necessary because the sheet 64 is seized by a gripper in the region of the front or leading edge 47 and moved off the feeding table 3. The gripper seizes the sheet 64 between the individual front lays.

How the device according to the invention operates or functions is described hereinafter in detail with reference to FIGS. 1 and 4. A sheet 64 coming from the righthand side, as represented in FIGS. 1 and 2, is transported in a direction towards the intercepting surface 48. The leading edge 65 of the sheet 64 strikes the intercepting surface 48. The sheet 64 is stopped and aligned, with the leading edge 65 thereof on the adjustment line 46.

After the sheet 64 is aligned and settled on the feeding table 3, it is seized by a gripper. The front lays 1 are then tilted away forwardly over the pivot angle 27 by rotating the shaft 6 about the central axis 63, as is represented in FIG. 4, and the sheet is drawn off and away from the feeding table 3. The shaft 6 is then tipped back into the working position thereof, so that the front lay 1 again assumes the working position thereof, as represented in FIG. 1. Because the front lay 1 is always in contact with the stop element 8 during the movement of the front lay 1 from the working position thereof into the neutral or inactive position thereof and back into the working position thereof again, the front lay 1, with respect to the stop element 8, is always at a defined spacing and always returns to the working position thereof at the same instant of time. Because it is unnecessary to take into account any time reserve for undefined swinging-away and returning, more time is available for aligning and stabilizing the sheet.

Figure 5:
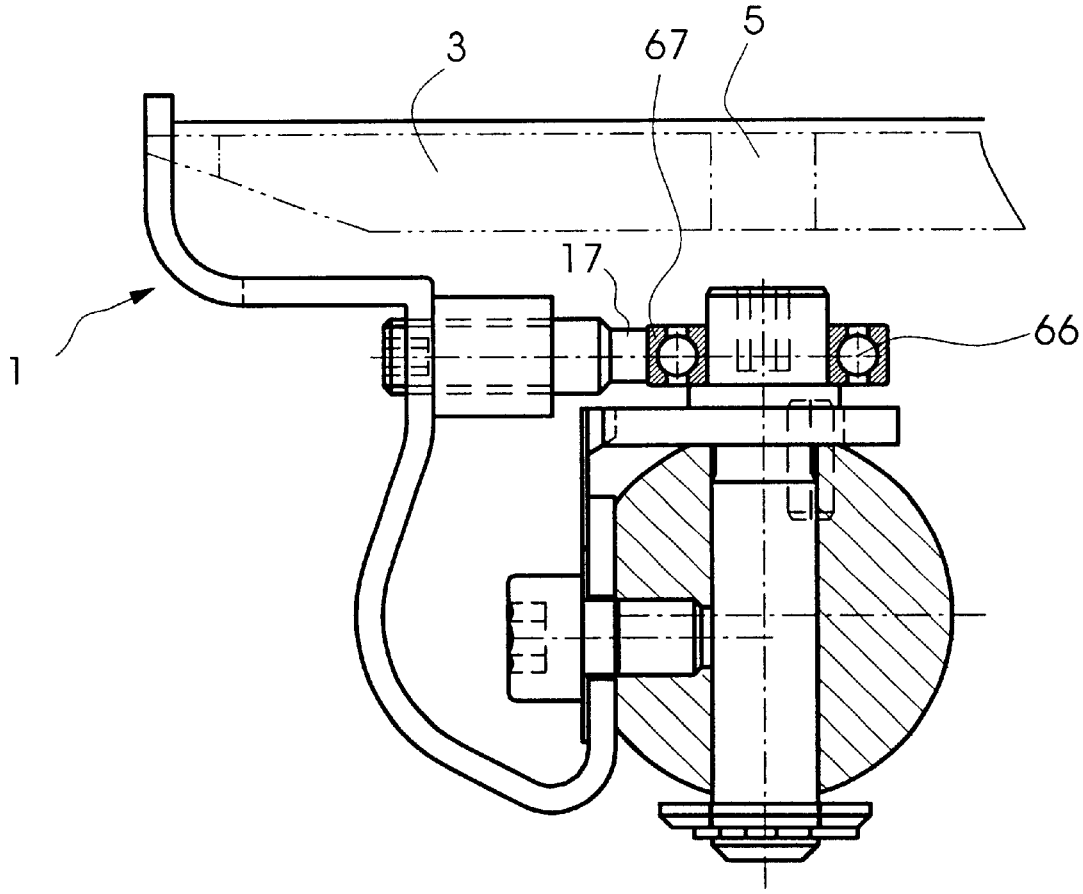
FIG. 5 is a view similar to that of FIG. 1 showing a front lay with an anti-friction bearing.

FIG. 5 illustrates an additional embodiment of the invention wherein the adjusting screw 17 engages the stop element 8 via an anti-friction bearing 66. In this regard, the adjusting screw 17 engages an exterior ring 67 of the anti-friction bearing under prestressing.

Figure 6:
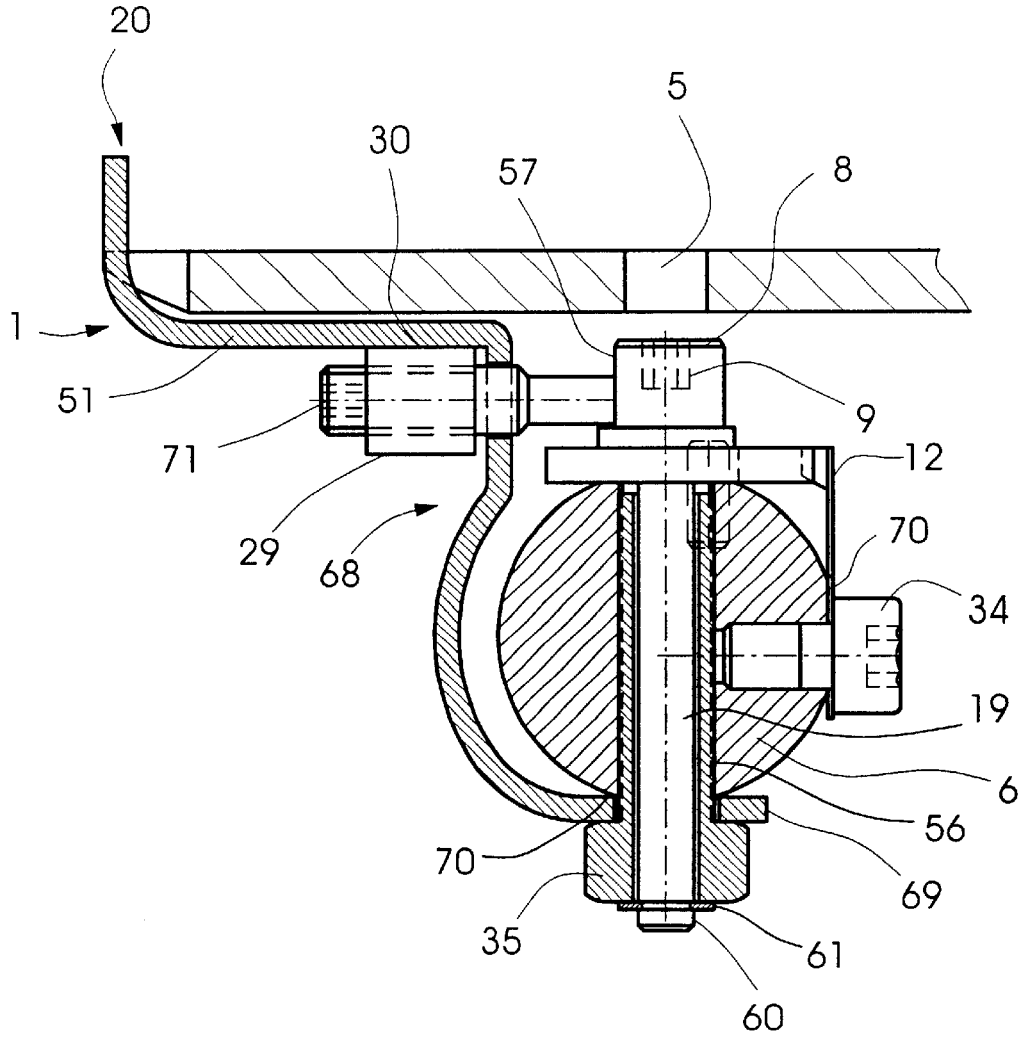
FIG. 6 is a view similar to that of FIG. 5 showing a front lay in a second embodiment.

FIG. 6 shows an additional embodiment of the invention wherein the front lay 1 has a different shape than that of FIG. 1. In FIG. 6, the first region 51 is longer and, shortly before the stop element 8, the first region 51 buckles downwardly in a direction towards the shaft 6 and merges into a fifth region 68. The fifth region 68 extends to a location beneath the shaft 6, and merges into a sixth region 69, which is disposed approximately parallel to the feeding table 3 and abuts a lower contact surface 70 of the shaft 6. The sixth region 69 is formed with an opening out of which the rod 19 extends in a downward direction. A hexagon screw 35 that has been bored through is provided for bolting the sixth region 69 to the lower contact surface 70 and thus fixes the front lay 1 in position. The rod 19 extends through the hollow hexagon screw 35 and is secured against axial movement. The hexagon screw 35 additionally has an exterior thread mating with an interior thread of the second borehole 56.

Also provided is a clamping or retaining nut 29 which is connected to the underside of the first region 51 of the front lay 1 via a weld 30. The clamping nut 29 has an inner thread through which a bolt 71, which extends through a corresponding opening in the fifth region 68 of the front lay 1 to the exterior perimeter 57 of the stop element 8, is screwed. The bolt 71 is screwed so far into the clamping nut 29 in the direction towards the stop element 8 that the basic adjustment of the intercepting surface 48 of the contact plate 20 is correctly performed. The shapes of the first, fifth and sixth regions 51, 68 and 69 of the front lay 1 are selected so that the fifth region 68 is biased in the direction towards the stop element 8 in the region of the bolt 71.

In this embodiment, the lock element 12 is fixed to the shaft 6 laterally opposite the fifth region 68 by a second screw 34. Accordingly, the lock disk 7 also is formed with the lock recesses 13 on the side of the lock element 12. In this embodiment also, the rod 19 extends downwardly through the hexagon screw 35 and has a connecting element 60 for connecting the servomotor 10 thereto.

Figure 7:
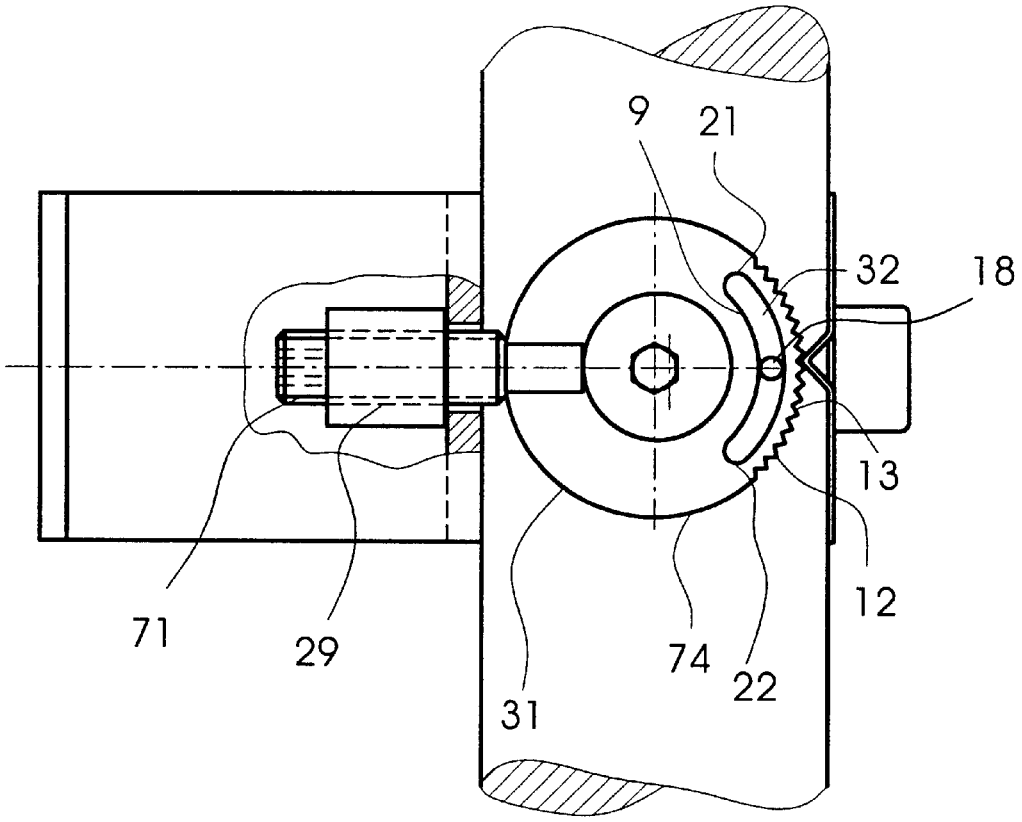
FIG. 7 is a top plan view similar to that of FIG. 2 showing a front lay in another embodiment with an adjusting device in the form of an Archimedes spiral.

FIG. 7 is a top plan view of an embodiment like that of FIG. 6, but with the stop element 8 constructed in the shape of an Archimedes' spiral 31. The Archimedes' spiral 31 is constructed approximately in the shape of a plate, with the distance from the spiral wall 74 to the axis of rotation varying in dependence upon the rotational position of the disk. In this way, the spacing between the bolt 71 and the axis of rotation of the Archimedes' spiral 31 can be varied in dependence upon the rotational position of the spiral 31. The illustrated embodiment of the Archimedes, spiral 31 is formed with a bolt opening 32 and has a graduated or index ring shape extending over a predetermined angular range at a defined distance from the axis of rotation. The two side edges of the bolt opening 32 are formed by first and second stop surfaces 21 and 22. The stop bolt 18 extends through the bolt opening 32 and serves to limit the permissible rotational angular range of the Archimedes' spiral 31.

Figure 8:
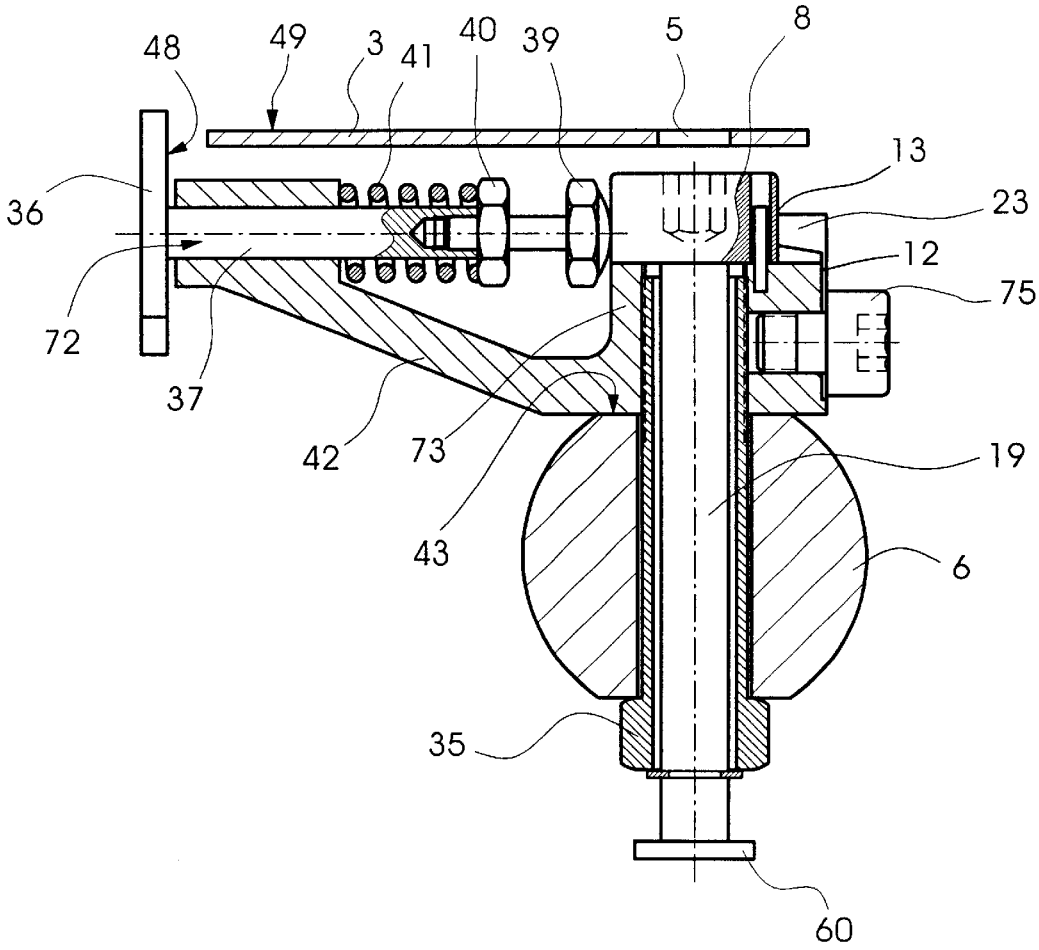
FIG. 8 is a view like that of FIG. 1 of a front lay in a third embodiment.

FIG. 8 shows an additional embodiment of the front lay 1, which includes a connecting part 37 and a plate 36. The connecting part 37 is mounted in a holding arm 42 parallel to the feeding table 3 and is movable parallel to the feeding table 3. The holding arm 42 is formed with a guide borehole 72 which is disposed parallel to the feeding table 3. The connecting part 37 is disposed so as to be axially movable in the guide borehole 72. An end of the connecting part 37 protrudes from the guide borehole 72 at an exterior side of the holding arm 42, and the connecting part 37 is connected at this end to the plate 36, which is disposed perpendicularly to the connecting part 37. The plate 36, at the top thereof, as viewed in FIG. 8, extends beyond the plane of the supporting surface 49 of the feeding table 3, and the interior side surface of the plate 36 serves as the intercepting surface 48.

The connecting part 37 protrudes from the borehole 72 in the direction towards the stop element 8, in like manner. At this end of the connecting part 37, a second adjusting screw 39 is screwed into the connecting part 37 via an inner thread formed therein. The second adjusting screw 39 includes a stop 40 in the form of a nut engaged by a tension spring. The tension spring 41 is placed in contact with the holding arm 42, as well, so that the second adjusting screw 39 is prestressed in the direction towards the stop element 8. The intercepting surface 48 of the plate 36 is also prestressed in the direction towards the stop element 8.

The holding arm 42 is fixed to the shaft 7 through the intermediary of a bushing 73 through which the rod 19 extends. In this regard, a second contact surface 43 of the bushing 73 comes into contact with a correspondingly assigned supporting surface of the shaft 6. The second contact surface 43 is expediently disposed parallel to the feeding table 3. The bushing 73 is fixed to the shaft 6 by a hollow-bored hexagonal screw 35. The hexagonal screw 35 has an exterior thread, which is suitably mated with an interior thread of the bushing 73. The rod 19, which is connected to the stop element 8, extends downwardly through the hollow-bored hexagonal screw 35 and out of the shaft 6 and the hexagonal screw 35. The bottom end of the rod 19 has a connecting element 60 for connecting a flexible shaft 11 and a servomotor 10 thereto.

The device in FIG. 8 has a leaf spring 12 located opposite to the second adjusting screw 39, which is fixed to the bushing 73 of the holding arm 42 by a third screw 75. A lock nose 23 of the lock element 12 is assigned to lock recesses 13 of a lock disk 7.

Figure 9:
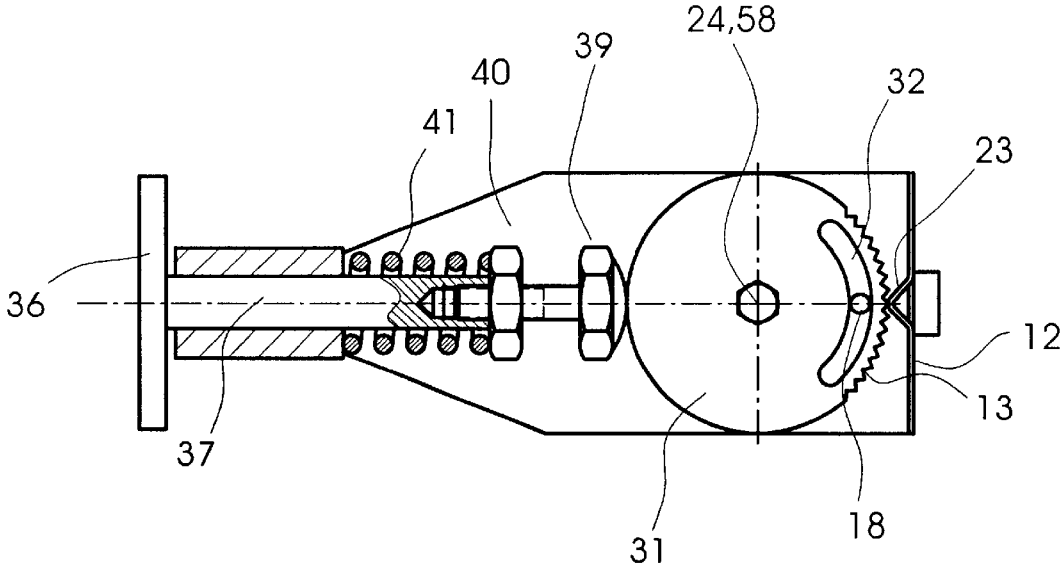
FIG. 9 is a view similar to that of FIG. 9 of the front lay of FIG. 8 from the perspective of the feeding table.

FIG. 9 is a top plan view of the device of FIG. 8, as viewed from the perspective of the feeding table 3. The shape of the Archimedes' spiral, which is formed with lock recesses 13 opposite the second adjusting screw 39, can be clearly recognized therein. In this embodiment, the function of the lock disk and the function of the stop element 8 are integrated in a single component. This permits the construction of a low building structure. The shape of the recess 58, which is bounded by an interior hexagonal form 24, can also be readily recognized.

The embodiment of FIG. 8 differs from the embodiment of FIG. 6 with respect to the development of the front lay 1.

An essential core of the invention is in constructing the front lay 1 and the stop element 8 as one internally stressed entity which is moved from a working or operating position in order to release the leading edge 65 of a sheet 64, into a neutral or inactive position wherein the contact plate 20 releases the leading edge 47. To accomplish this, the component can be moved, swung or rotated in any manner whatsoever. The shaft 6 used in the foregoing description, to which the stop element 8 and the front lay 1 are fastened, merely represents a preferred embodiment. The invention is not limited to using a shaft 6.

For example, the front lay 1 and the stop element 8 can also be fastened onto a component which is swung away from the leading edge 47 of the sheet by using lever arms in order to release the leading edge 47.

Furthermore, the invention is exemplarily described as having a rotary element as the adjusting device 4. But other shapes can be used to adjust the position of the front lay relative to the edge of the sheet.

The holder 2, e.g., formed of the shaft 6 and the screw 14, can be displaceably mounted. By this measure, all front lays can be displaced jointly in or opposite to the direction of sheet transport, i.e., at an angle.

I claim:

1. A device for fixing the position of a sheet, comprising a feeding table for transporting the sheet; at least one front lay disposed in vicinity of said feeding table and, in a working position, protruding upwardly beyond the plane of said feeding table; a swivellable holder to which said front lay and an adjusting device for said front lay are secured, said front lay and said adjusting device being disposed and separated from one another on said holder; and an adjusting mechanism disposed for biasing said front lay under tension relative to said adjusting device, said front lay and said adjusting device being movable from said working position into a neutral position and, conversely, from said neutral position into said working position, by changing the position of said holder.

2. The position-fixing device according to claim 1, wherein said adjusting device is rotatably mounted, and is rotatable for adjusting the position of said front lay.

3. The position-fixing device according to claim 2, wherein said adjusting device is formed with lock recesses and includes a lock element, said lock recesses cooperating with said lock element for enabling rotation of the said adjusting device at prescribed angles.

4. The position-fixing device according to claim 3, wherein said lock element is constructed as a leaf spring, which is prestressed with the aid of a lock nose in a direction towards said adjusting device and, when said adjusting device is rotated, said lock element catches in said lock recesses, so that said adjusting device is rotatable further only with increased torque.

5. The position-fixing device according to claim 3, wherein said adjusting device is connected to a disk formed with lock recesses in a side margin thereof; said disk having a first and a second stop surface; and including a stop bolt disposed between said first and said second stop surfaces, said stop bolt, by coming into contact with said first and said second surfaces, serving to limit the range of rotation of said adjusting device.

6. The position-fixing device according to claim 2, including a servomotor connected to said adjusting device for adjusting the rotational position of said adjusting device.

7. The position-fixing device according to claim 2, wherein said adjusting device is formed with a contact surface to which a tool for adjusting the position of said adjusting device is applicable.

8. The position-fixing device according to claim 7, wherein said adjusting device is disposed beneath said feeding table; and said feeding table is formed with an opening in vicinity of said adjusting device, via which said contact surface is accessible with the aid of a tool.

9. The position-fixing device according to claim 1, wherein said adjusting device includes a rotary element mounted so as to be rotatable about an axis of rotation; said front lay having a contact part in contact with a side margin of said rotary element; at least one of said rotary element and the position of the axis of rotation are constructed so that, when the rotary element is rotated about the axis of rotation, a spacing between said contact part and said axis of rotation is modified.

10. The position-fixing device according to claim 9, wherein said contact part and said rotary element are operatively connected to one another via at least one of an anti-friction bearing and a slide ring.

11. The position-fixing device according to claim 9, wherein said rotary element is formed as an Archimedes' spiral.

12. The position-fixing device according to claim 9, wherein said rotary element is formed as a disk which is rotatable about an eccentrically disposed axis of rotation.

13. The position-fixing device according to claim 1, wherein said adjusting mechanism serves for adjusting the spacing between said front lay and said adjusting device.

14. The position-fixing device according to claim 1, including at least one tensioning mechanism for prestressing said front lay in a direction towards said stop element.

15. The position-fixing device according to claim 1, wherein said front lay is formed at least partly of an elastic material; and is secured to said holding device in a manner that said front lay is prestressed in a direction towards said adjusting device.

* * * * *